United States Patent [19]

Plech, Jr.

[11] 4,047,716

[45] Sept. 13, 1977

[54] PEG GAME WITH SPINNER-TYPE TIMER

[76] Inventor: John Plech, Jr., 4407 Broadale Ave., Cleveland, Ohio 44109

[21] Appl. No.: 678,934

[22] Filed: Apr. 21, 1976

[51] Int. Cl.[2] ..... A63F 9/00

[52] U.S. Cl. ..... 273/1 R; 273/135 R; 273/136 C

[58] Field of Search ..... 273/1 R, 86 C, 141, 273/142 R, 148 R, 130 R, 135 R, 136 C, 134 B, 134 E, 135 AC; 46/47

[56] References Cited

U.S. PATENT DOCUMENTS

| | | | |
|---|---|---|---|
| 235,951 | 12/1880 | Lawrence | 273/136 C |
| 655,768 | 8/1900 | Eynon et al. | 273/135 AC |
| 2,423,198 | 7/1947 | McClure, Jr. | 46/47 |
| 2,463,425 | 3/1949 | Rendel | 273/136 C |
| 3,425,698 | 2/1969 | Steiert et al. | 273/141 A |
| 3,674,264 | 7/1972 | Boercker | 273/130 R |
| 3,713,656 | 1/1973 | Cooper et al. | 273/135 R |
| 3,721,440 | 3/1973 | Burns | 273/1 R |
| 3,754,763 | 8/1973 | Breslow | 273/134 B |
| 3,948,526 | 4/1976 | Lukacik | 273/136 C |
| 3,961,794 | 8/1976 | Goldfarb et al. | 273/135 R |

FOREIGN PATENT DOCUMENTS

| | | | |
|---|---|---|---|
| 646,214 | 7/1937 | Germany | 273/141 R |

*Primary Examiner*—Anton O. Oechsle
*Assistant Examiner*—Harry G. Strappello
*Attorney, Agent, or Firm*—Donnelly, Maky, Renner & Otto

[57] ABSTRACT

A game includes a plurality of pegs to be removed from a board by a player in a timed play duration determined by a timer set in motion by the player. The timer mounted on the game board includes a rod and a disc positioned thereabout so that a player can determine his own timed play duration by raising the disc to the top of the rod and spinning the disc so that it resists falling immediately to the board whereupon the timed duration expires.

8 Claims, 2 Drawing Figures

PEG GAME WITH SPINNER-TYPE TIMER

BACKGROUND OF THE INVENTION

The present invention relates, as indicated, to a game and, more particularly, to a game with removable pegs and a spinning-type timer.

In one type of prior art pegboard game the player simply inserts pegs into the holes of a pegboard to construct designs and the like, and one advantage of this type of a game is the manual dexterity and hand-eye coordination learned thereby. In another type of peg game the pegs are jumped one over another followed by removal of the jumped pegs from the board with the goal in mind being to remove in that manner as many pegs as possible; and scoring in this game may be related to the time required for a player to exhaust his possible moves during his turn at play.

SUMMARY OF THE INVENTION

In the present invention play members, such as pegs, are to be removed from or to be placed on a board, for example by removing them from or inserting them in holes on the board, by a player during play. A timed duration available to a player for removing or replacing the play members is determined by the player himself first operating a timer device that is coupled to the game board. In its more preferred form the timer device includes an upstanding rod secured to the game board and a disc rotatably positioned on the rod and relatively freely movable therealong so as normally to be drawn toward the game board by the force of gravity; however, a player may spin the disc on the rod to develop frictional forces therebetween that oppose the gravitational force and thus increase the time necessary for the disc to fall to the board, thus determining the mentioned time duration.

Moreover, means for determining the number of plays, i.e. the number of timed durations available, to a player in each turn also may be provided on the board.

With the foregoing in mind it is a principal object of the invention to provide a game improved in the noted respects.

Another object is to develop manual dexterity and hande-eye coordination.

An additional object is to provide a game that may be played with varying levels of skill and, therefore, appeals to people over a relatively wide age range.

These and other objects and advantages of the present invention will become more apparent as the following description proceeds.

To the accomplishment of the foregoing and related ends, the invention, then, comprises the features hereinafter fully decribed and particularly pointed out in the claims, the following description and the annexed drawing setting forth in detail a certain illustrative embodiment of the invention, this being indicative, however, of but one of the various ways in which the principles of the invention may be employed.

DESCRIPTION OF THE PREFERRED EMBODIMENT

Figure 1:
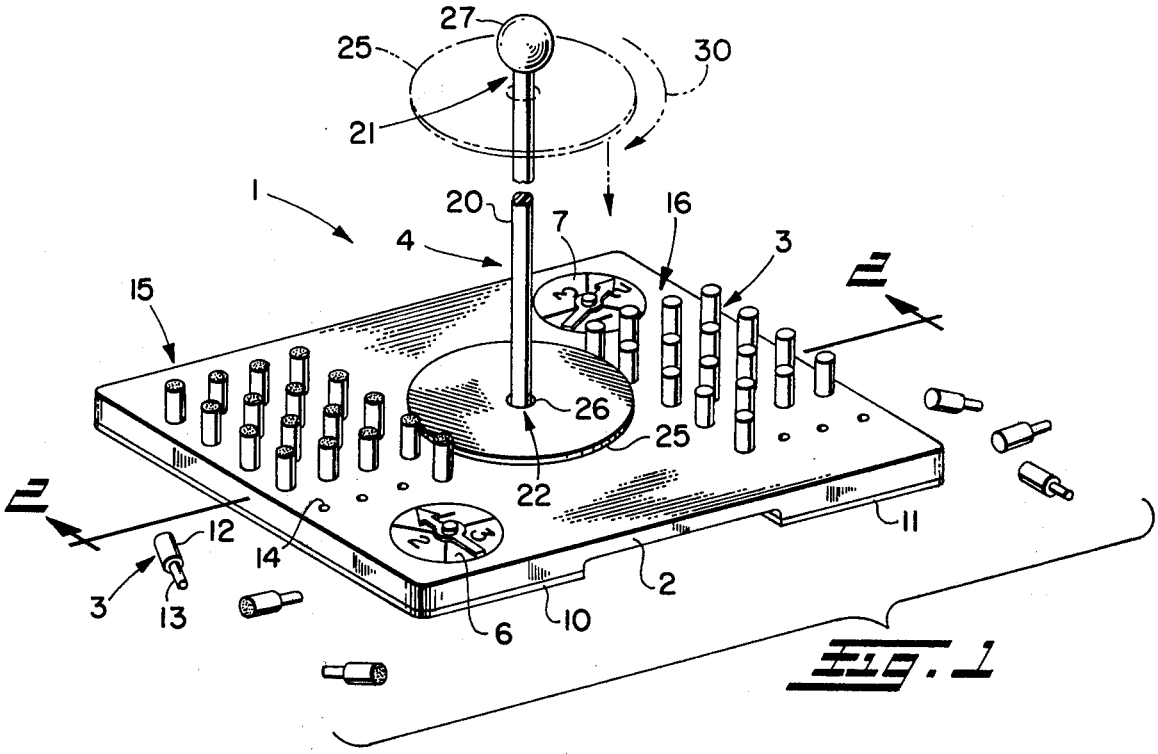
FIG. 1 is an isometric view, partly exploded to show several of the play members removed, of a game in accordance with the invention.
Figure 2:
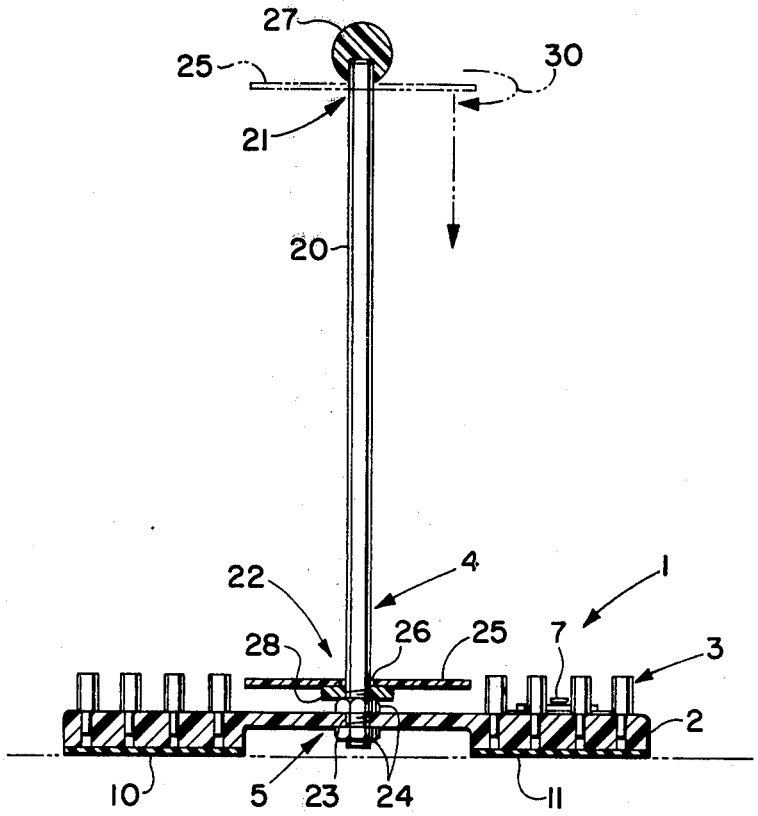
FIG. 2 is a section view of the game of FIG. 1 looking generally in the direction of the arrows 2—2 thereof.

Referring now more particularly to the drawing, wherein like reference numerals designate like parts in the several figures, a game in accordance with the invention is generally indicated at 1 in FIGS. 1 and 2. The game 1 includes a board 2 with a plurality of play members generally indicated at 3 positionable on the board and a timer device 4 coupled to the board at 5, as is illustrated in an exemplary manner particularly in FIG. 2. Moreover, several spinners 6, 7 are located on the board and may be used by respective players to determine the number of plays they will have in their respective turns.

The board 2 is preferably formed of relatively strong, rigid material, such as, for example, metal, plastic, fiberglass or the like, and non-slip pads 10, 11, for example of rubber or other similarly non-slipping type material, may be provided on the bottom of the board to resist slipping thereof when the game 1 is positioned on a table or other support surface. The play members 3 are preferably pegs, which may be formed of wood, plastic, Nylon, metal, or other suitable material, each having a main body portion 12 and a relatively narrower tip 13, and to accommodate those pegs the board 2 has a plurality of holes 14 arranged in two respective groups 15, 16 on opposite sides of the board relative to the timer device 4. The holes in each group 15, 16, one group for each of two players, are preferably arranged in identical patterns, and each of the play member pegs 3 may be inserted or removed from the respective holes during play. Although a preferred form of play member peg is illustrated and described herein, it will be appreciated that other types of play members may be employed, such as, for example, marbles that are retained in detents in the surface of the board 2, for example, or magnetic parts, such as magnetic discs, that would adhere to an iron board and would be placed on circles or other indicia applied to the surface of such board. Other types of play members also may be equivalently employed in the game.

The timer device 4 is used by each player to determine the amount of time or a timed duration available to each player in each play of his turn. Accordingly, the timer device 4 includes an elongate member 20 having opposite upper and lower ends 21, 22, the latter having a threaded portion that passes through an opening 23 in the board to be secured to the latter by a pair of nuts 24, and a circular disc 25, which has a generally centrally located opening 26 through which the elongate member 20 passes allowing the disc to move along the major extent of the elongate member 20. Preferably the elongate member 20 is a rigid rod of circular cross section with a straight longitudinal axis between the top and bottom ends 21, 22 and generally vertically extending perpendicular to the generally planar extent of the board 2, and the rod may be formed of metal, plastic, wood, or other suitable material. However, if desired, the elongate member 20 may have other than a circular cross section or it may even be comprised of a resilient material, such as an elongate coiled spring-like member. The upper end 21 of the elongate member 20 preferably includes an enlargement 27 to facilitate manual grasping thereof by a player, and the enlargement 27 may be comprised of a wood, plastic, metal, rubber or the like ball secured by a threaded, adhesive or the like connection to the end of the elongate member 20.

The disc 25, which is shown in phantom in its raised position near the upper end 21 of the elongate member 20, preferably is flat and has a circular shape, although it may have other shapes, if desired, such as rectangular, hexagonal, ellipsoidal, etc. Moreover, the disc 25 may be formed of cardboard, plastic, wood, metal or other suitable material to provide it with sufficient strength preferably without causing the disc to be too heavy. A washer 28 may be positioned about the elongate member 20 at its lower end 22 above the upper nut 24 to provide a table-like support for the disc 25 and to prevent wearing of the disc by the hard and possibly sharp edges of the nut. The washer 28 also holds the disc sufficiently above the plane of the board 2 to facilitate grasping of the disc by a player.

When using the timer device 4 to determine a timed duration of play for a player, the player normally would lift the disc to a position along the elongate member 20 near the upper end 21 thereof. The player would then spin the disc fairly rapidly with his hand and/or fingers, for example in the direction of the arrow 30, thereby creating forces due to friction between the disc at its opening 26 and the elongate member 20 to resist the force of gravity that tends to draw the disc downward in the direction of the arrow 31 toward the board 2. Accordingly, the timed duration provided by the timer device 4 will be dependent on the dimensions of the disc opening 26, the mass of the disc 25 and its distribution, the cross sectional and linear dimensions of the elongate member 20, the relative frictional coefficients of the disc and the elongate member, and the rotational speed applied to the disc as the player spins the same, all of which affect the centrifugal forces of the spinning disc, the rotational or angular momentum thereof, and the effective opposing force or resistance to the gravitational force that tends to pull the disc downward until it abuts the washer 28.

To play the game 1, a first player would spin the spinner 6, for example, and the digit to which the spinner points at rest would indicate the number of plays that player has in his turn, say one play as shown by the stopped spinner 6. That first player would then raise the disc 25 to the upper end 21 of the elongate member 20 and would spin the disc. While the disc is spinning and before it falls to the washer 28, the first player would attempt to remove as many as possible of his group of pegs on his side of the board 2. After the first player's timed duration has expired by the disc 25, coming to touch or to rest on the washer 28, the second player would take his turn by first spinning the spinner 7, which as illustrated gives him two plays in his turn, similarly operating the timer device 4, and removing as many pegs as he can in each of his two timed duration plays in his turn. After the second player has completed his two plays in his turn, the first player would again have a turn, etc. Play would continue in this manner until one of the players has removed all of his play members 3 from the board 2; however, the degree of difficulty in playing the game may be increased, for example, by also extending the game to require the players to return the play members back to their respective positions on the board 2 in further timed duration plays.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

The embodiments of the invention in which an exclusive property or privilege is claimed are defined as follows:

1. A game, comprising a board, a plurality of play members positionable on said board, said play members being removable from and positionable on said board by a player during a play, timer means for timing a duration for each play, said timer means including an elongate, relatively rigid rod-like member having a generally rounded cross section and opposite ends, and movable, relatively rigid disc-like means movably positioned with respect to said rod-like member for moving in a direction from one to the other of said ends in response to gravitational force, said disc-like means having a substantially centrally located opening through which said rod-like member extends, whereby upon rotation of said disc-like means the centrifugally created frictional forces with said rod-like member tend to oppose such gravitational forces to reduce the speed at which said disc-like means moves in said direction and thereby to time such duration, and said opening being of a sufficiently larger size than such rounded cross section, whereby when said disc-like means is not rotating it is relatively freely movable on said rod-like member, and means for coupling said timer means to said board.

2. A game as set forth in claim 1, wherein said disc-like means comprises a relatively flat, circular disc, said rod-like member has a circular cross section, and said opening has a circular configuration of a larger diameter than such circular cross section.

3. A game as set forth in claim 1, wherein said means for coupling comprises means for mounting one end of said rod-like member to said board, and further comprising an enlargement means at the other end of said rod-like member for facilitating manual grasping thereof.

4. A game as set forth in claim 3, further comprising means for resisting sliding of said board where the latter is resting on a supporting surface.

5. A game as set forth in claim 1, wherein said board includes a plurality of holes and said plurality of play members comprise a plurality of pegs insertable into said respective holes.

6. A game as set forth in claim 5, wherein said plurality of holes comprise first and second groups of holes respectively on opposite sides of said board relative to said timer means, said holes in each group being arranged in substantially identical patterns.

7. A game as set forth in claim 1, further comprising means for determining the number of plays by a player in each turn.

8. A game as set forth in claim 7, wherein said means for determining comprises a spinner mounted on said board.

* * * * *